US006230705B1

(12) United States Patent
Kuo

(10) Patent No.: US 6,230,705 B1
(45) Date of Patent: May 15, 2001

(54) RESPIRATORY TUBE CAPABLE OF REGULATING AIR-BLOWING PRESSURE

(76) Inventor: Tzong-Fuh Kuo, No. 21, Alley 5, Lane 49, How Gaang 1st Rd., Hsin Juang City, Taipei Hsien (TW)

( * ) Notice: Subject to any disclaimer, the term of this patent is extended or adjusted under 35 U.S.C. 154(b) by 0 days.

(21) Appl. No.: 09/265,633

(22) Filed: Mar. 10, 1999

(51) Int. Cl.[7] ..... B63C 11/16
(52) U.S. Cl. ..... 128/201.11
(58) Field of Search ..... 128/201.11, 201.26, 128/201.27, 201.28, 204.26, 205.24

(56) References Cited

U.S. PATENT DOCUMENTS 4,574,797 * 3/1986 Christianson ..... 128/204.26
4,616,645 * 10/1986 Pedersen et al. ..... 128/204.26
4,655,212 * 4/1987 Delphia ..... 128/201.11
4,834,084 * 5/1989 Walsh ..... 128/201.11
4,860,739 * 8/1989 Vandepol ..... 128/201.11
4,872,453 * 10/1989 Christianson ..... 128/201.11
4,877,022 * 10/1989 Christianson ..... 128/201.11
4,884,564 * 12/1989 Lamont ..... 128/201.11
5,163,920 * 11/1992 Olive ..... 604/247
5,657,746 * 8/1997 Christianson ..... 128/201.11
5,671,728 * 9/1997 Winefordner et al. ..... 128/201.11
5,701,890 * 12/1997 Pietrelli ..... 128/205.24
5,845,635 * 12/1998 Hermansen et al. ..... 128/201.11
5,868,129 * 2/1999 Christianson ..... 128/201.11

* cited by examiner

*Primary Examiner*—Glenn K. Dawson
*Assistant Examiner*—Joseph F. Weiss, Jr.
(74) *Attorney, Agent, or Firm*—Pro-Techtor International Services

(57) ABSTRACT

A respiratory tube capable of regulating air-blowing pressure, including a regulation switch disposed at the intake tube of the respiratory tube for regulating the upper and lower component blowing pressure of the respiratory tube. The regulation switch is disposed with a movable damper board which is curved. By means of left and right shifting the damper board, the direction and pressure value of the air blown into the intake tube can be controlled so as to control the upward and downward directed pressure of the air flow blown into the respiratory tube. Therefore, the direction and pressure of the blown in air are adjustable in accordance with different vital capacity of different users.

3 Claims, 2 Drawing Sheets

RESPIRATORY TUBE CAPABLE OF REGULATING AIR-BLOWING PRESSURE

BACKGROUND OF THE INVENTION

The present invention relates to a respiratory tube capable of regulating air-blowing pressure, in which a specifically designed damper board is disposed in an intake tube of the respiratory tube, whereby the direction and pressure value of the blown in air are adjustable in accordance with the requirements of different users.

FIG. 5 shows the structure of a conventional respiratory tube used in diving, which includes a respiratory tube main body la and an intake tube 2*a* connected with each other. A blowing manifold 3*a* is disposed on one side of the intake tube 2*a* for a user to hold in the mouth and breathe. However, it is known in diving field that when a diver deeply dives into water and then buoys out of the water, the diver must blow out the water accumulating in the respiratory tube by a blowing pressure. However, according to the structure of the conventional respiratory tube, a check membrane valve 4*a* is disposed on the bottom of a lower section of the respiratory tube so that the accumulating water can be only exhausted and cannot flow back into the respiratory tube. The other end of the respiratory tube is an open end ( not shown ) enabling the accumulating water to be exhausted and a user to normally breathe. Therefore, when the user blows air into the respiratory tube to exhaust the accumulating water, a part of the water will be downward exhausted through the membrane valve 4*a* and the other part of the water will be upward exhausted through the open end. However, the pressure of the air blown by the user into the respiratory tube is unified and the membrane valve 4*a* of the respiratory tube is subject to water pressure and the resistance against exhaustion of the water is increased so that in fact, most of the accumulating water is exhausted from the upper open end. The length from the intake tube 2*a* to the upper open end is longer. According to pressure principle, the blowing pressure will be correspondingly increased. Therefore, for a beginner or a female user, the blowing pressure is often insufficient and thus the accumulating water is often not totally exhausted and is sucked into the mouth to cause danger. It is necessary to solve this problem so as to ensure safety.

SUMMARY OF THE INVENTION

It is therefore a primary object of the present invention to provide a respiratory tube capable of regulating air-blowing pressure, including a regulation switch disposed at the intake tube of the respiratory tube for regulating the upper and lower component blowing pressure of the respiratory tube. The regulation switch is disposed with a left and right movable damper board which is curved. By means of left and right shifting the damper board, the direction and pressure value of the air blown into the intake tube can be controlled so as to control the pressure of the air flow blown into the respiratory tube upward directed to the open end and downward directed to the membrane valve. By means of the regulation switch, a user can adjust the damper board to a specific position according to different blowing pressure. With respect to a user with insufficient vital capacity and blowing pressure, the damper board is such adjusted that the pressure of the downward directed air flow for exhausting the water from the membrane valve is increased. Reversely, the pressure of the upward directed air flow for exhausting the water from the upper open end is increased.

The present invention can be best understood through the following description and accompanying drawings, wherein:

DETAILED DESCRIPTION OF THE PREFERRED EMBODIMENT

Figure 1:
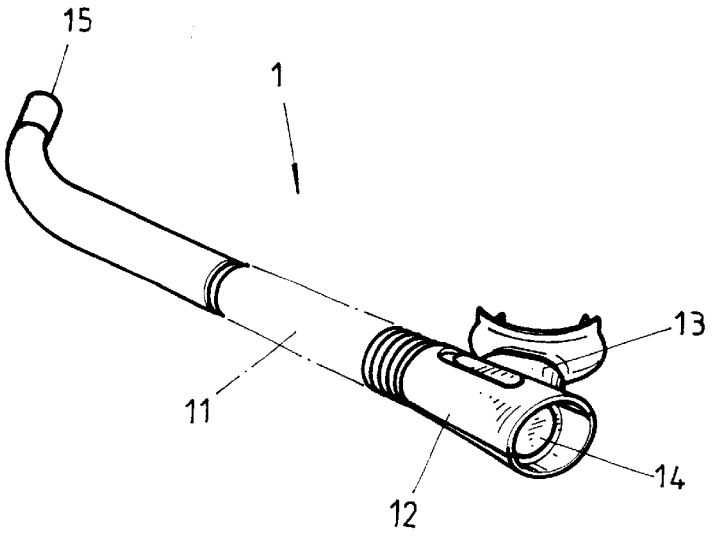
FIG. 1 is a perspective assembled view of the present invention.

Please refer to FIG. 1. The respiratory tube 1 of the present invention is similar to the conventional respiratory tube in appearance, including a main body 11, an intake tube 12 and a blowing manifold 13. A lower end of the respiratory tube 1 is disposed with a check membrane valve 14, while an upper end thereof is formed with an open end 15. A regulation switch 2 is disposed at the intake tube 12 of the respiratory tube 1 for regulating the upper and lower component blowing pressure of the respiratory tube 1. By means of the regulation switch 2, the exhaustion direction and amount of the accumulating water in the respiratory tube 1 can be controlled in accordance with the vital capacity of different users.

Figure 2:
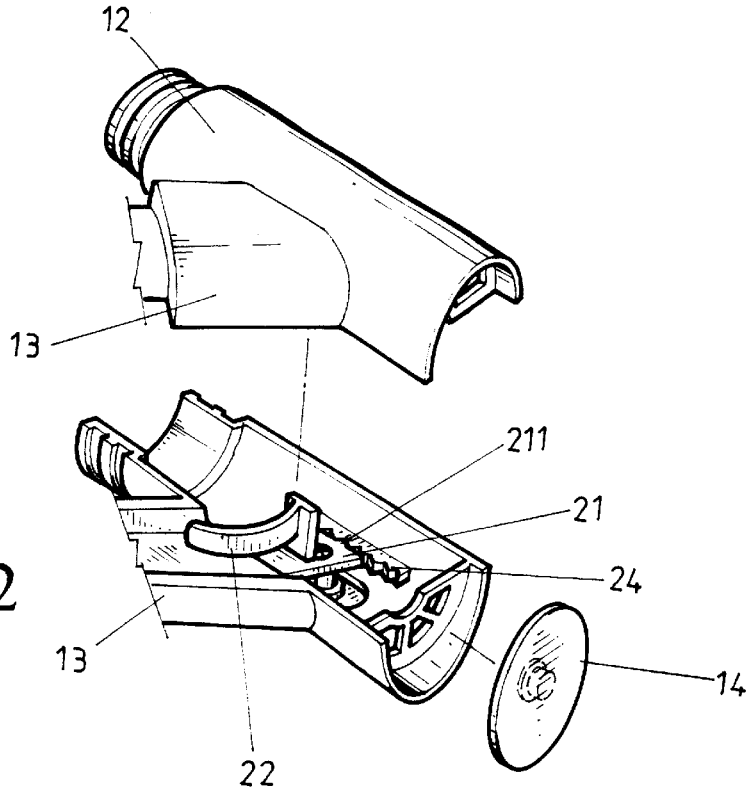
FIG. 2 is a perspective exploded view of a part of the present invention.
Figure 3:
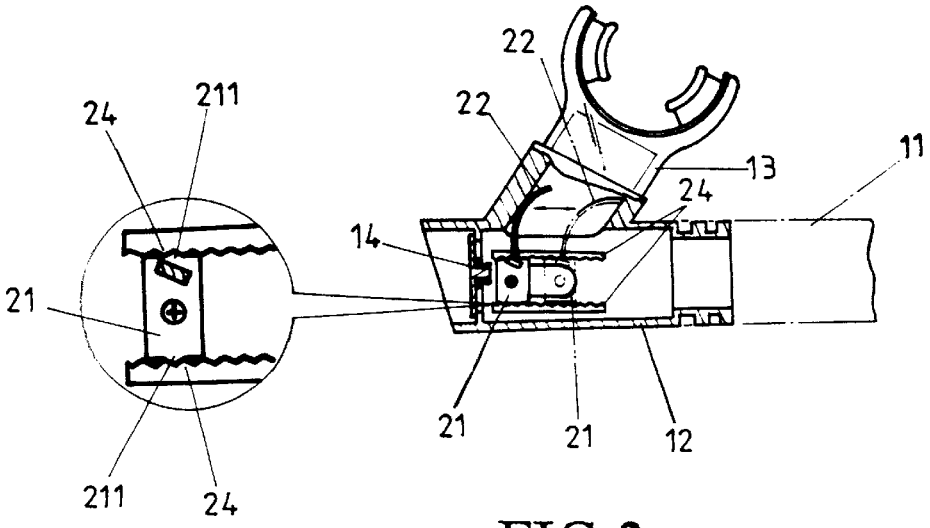
FIG. 3 is a sectional assembled view of the present invention.
Figure 4:
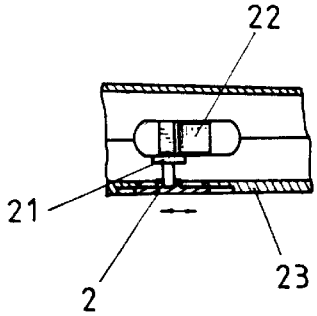
FIG. 4 shows the operation of the regulation switch of the present invention.
Figure 5:
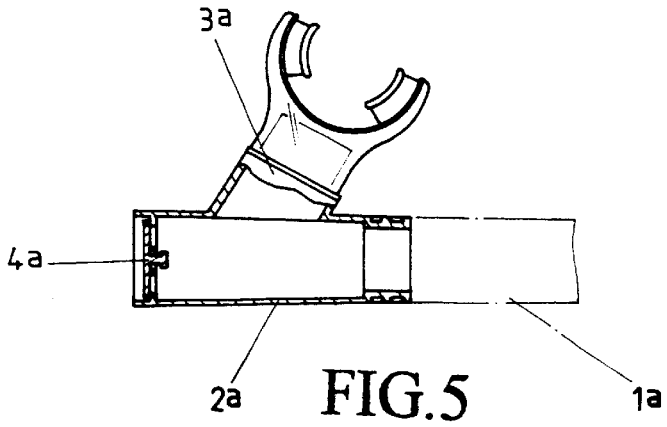
FIG.5 (PRIOR ART)
FIG. 5 is a sectional of the structure of a conventional respiratory tube.

Please refer to FIGS. 2 to 4. The regulation switch 2 is locked with a damper board 22 via an angle board 21 for controlling the damper board 22 which is left and right movably disposed in the intake tube 12. The damper board 22 is curved and has a width substantially equal to the diameter of the blowing manifold 13. By means of left and right displacement of the damper board 22, the direction and pressure value of the air blown into the intake tube 12 can be controlled. As shown in FIG. 3, when the damper board 22 is shifted to leftmost position, the top point of the curve of the damper board 22 just touches one side of the blowing manifold 13, whereby the blown air flow is upward directed to the open end 15. Reversely, when the damper board 22 is shifted to the rightmost position, the top touches the other side of the blowing manifold 13, whereby the blown air is downward directed to the membrane valve 14. Accordingly, by means of shifting the damper board 22 left and right, the direction and pressure of the blown in air can be adjusted in accordance with different blowing pressure of different users.

As shown in FIGS. 3 and 4, the regulation switch 2 is disposed on outer circumference of the wall of the intake tube 12 and underlaid by a waterproof rubber pad 23 for keeping watertightness. The inner wall of the intake tube 12 is disposed with symmetrical upper and lower racks 24 along a linear shifting direction of the regulation switch 2. In cooperation with the racks 24, an upper and a lower sides of the angle board 21 are respectively disposed with two rows of flexible teeth 211. When pushing the regulation switch 2, the flexible teeth 211 are moved along the upper and lower racks 24 to engage with the same stage by stage. Therefore, the regulation switch 2 is microadjustably shifted stage by stage. In actual use, it is unnecessary to adjust the damper board 22 to the left or right dead end, so that the spaces for the air flow on upper and lower sides of the interior of the main body 11 and the intake tube 12 are communicated with each other and the normal breathing of the user will not be affected. With respect to a beginner or a female user with insufficient vital capacity, the regulation switch is such adjusted that the amount of the downward directed air flow (to the membrane valve) is greater. Therefore, the lower section of the respiratory tube with narrower space by means of the compressed air can quickly and easily exhaust most of the accumulating water through the membrane valve 14. At the same time, without great blowing pressure, the remaining less accumulating water can be exhausted from the upper open end 15. Reversely, a skilled user can such adjust the regulation switch as to direct the air flow upward to exhaust the water from the upper open end 15.

In conclusion, the respiratory tube of the present invention enables a user to regulate the direction and pressure of the air flow blown into the respiratory tube to meet the requirement of the user for blowing air and exhausting the water.

It is to be understood that the above description and drawings are only used for illustrating one embodiment of the present invention, not intended to limit the scope thereof. Any variation and derivation from the above description and drawings should be included in the scope of the present invention.

What is claimed is:

1. A respiratory tube capable of regulating air-blowing pressure, comprising:

a main body, an intake tube and a blowing manifold; wherein a first end of said respiratory tube comprising an open end, and a second end of said respiratory tube comprising a check membrane valve; and wherein, a regulation switch disposed in the intake tube of said respiratory tube to regulate air-blowing pressure of said respiratory tube, said regulation switch being locked with a damper board via an angle board, said angle board controlling a position of said damper board which is movable side to side in said intake tube, said damper board being curved and having a width substantially equal to a diameter of the blowing manifold, whereby lateral displacement of said damper board controls direction and pressure of air blown into said intake tube, when said damper board is shifted to a first position wherein a top point of a curved portion of said damper board contacts a first side of said blowing manifold, said air blown into said intake tube is directed toward said open end of said respiratory tube, and conversely, when said damper board is shifted to a second position wherein said top point of said curved portion of said damper board contacts a second side of said blowing manifold, said air blown into said intake tube is directed toward said membrane check valve of said respiratory tube; such that by shifting said damper board from said first side to said second side of said blowing manifold said direction and pressure of said air blown into said intake tube is adjustable according to a preference of a user.

2. The respiratory tube of claim 1 wherein:

said regulation switch is disposed on an outer circumference of a wall of said intake tube, said regulation switch is underlaid by a waterproof rubber pad to maintain a watertight seal between said switch and said wall.

3. The respiratory tube of claim 1 wherein:

an inner wall of said intake tube comprises symmetrical first and second racks flanking the regulation switch and in linear, shifting cooperation with the regulation switch, and first and second sides of said angle board and each disposed with a row of flexible teeth; such that when a user pushes said regulation switch, said flexible teeth are moved along said first and second racks to engage said first and second racks stage by stage, so that said regulation switch is microadjustably shifted stage by stage.

* * * * *